US006259884B1

(12) United States Patent
Oberhoffner

(10) Patent No.: US 6,259,884 B1
(45) Date of Patent: Jul. 10, 2001

(54) METHOD FOR PRINTING INDIVIDUAL SHEETS IN GROUPS USING THE DUPLEX METHOD

(75) Inventor: Gerhard Oberhoffner, München (DE)

(73) Assignee: Oce Printing Systems GmbH (DE)

( * ) Notice: Subject to any disclaimer, the term of this patent is extended or adjusted under 35 U.S.C. 154(b) by 0 days.

(21) Appl. No.: 09/647,432

(22) PCT Filed: Mar. 31, 1999

(86) PCT No.: PCT/EP99/02232

§ 371 Date: Nov. 20, 2000

§ 102(e) Date: Nov. 20, 2000

(87) PCT Pub. No.: WO99/50715

PCT Pub. Date: Oct. 7, 1999

(30) Foreign Application Priority Data

Mar. 31, 1998 (DE) ..... 198 14 384
Aug. 13, 1998 (DE) ..... 198 36 746

(51) Int. Cl.[7] ..... G03G 15/00

(52) U.S. Cl. ..... 399/361; 399/16; 399/364; 399/381; 101/211

(58) Field of Search ..... 101/211; 399/361, 399/16, 364, 381, 405; 355/319, 320, 309, 200; 271/225, 186, 301; 400/619; 347/16, 104

(56) References Cited

U.S. PATENT DOCUMENTS 4,591,884 5/1986 Miyamoto et al. .
4,972,236 * 11/1990 Hasegawa ..... 355/319
5,049,946 * 9/1991 Harada ..... 355/309
5,150,167 * 9/1992 Goada et al. ..... 355/200
5,162,845 * 11/1992 Ariyama et al. ..... 355/200
5,337,135 8/1994 Malachowski et al. .
5,369,480 * 11/1994 Isobe ..... 355/320
5,384,619 * 1/1995 Yokomizo et al. ..... 355/200
5,449,166 * 9/1995 Lohmann et al. ..... 271/225
5,499,091 * 3/1996 Kasiwahara ..... 355/319
5,598,257 * 1/1997 Keler ..... 399/364
5,730,535 3/1998 Keller et al. .
5,746,526 * 5/1998 Hirose ..... 400/619
6,101,364 * 8/2000 Boehmer et al. ..... 399/361
6,134,418 * 10/2000 Kain et al. ..... 399/405

FOREIGN PATENT DOCUMENTS 39 18 961 C2 12/1989 (DE) .
2 144 296 2/1985 (GB) .
2 229 137 9/1990 (GB) .
WO 91/13386 9/1991 (WO) .

* cited by examiner

*Primary Examiner*—Eugene Eickholt
(74) *Attorney, Agent, or Firm*—Schiff Hardin & Waite

(57) ABSTRACT

A method and apparatus for printing individual sheets gathers the sheets in groups and feeds the sheets past a printer unit. Paper paths are provided in two ring shapes and two printers are provided to permit printing on one side in one color, both sides in one color, one side in two colors and two sides in two colors or one color on one side and two colors on the other side.

32 Claims, 28 Drawing Sheets

METHOD FOR PRINTING INDIVIDUAL SHEETS IN GROUPS USING THE DUPLEX METHOD

BACKGROUND OF THE INVENTION

1. Field of the Invention

The invention is directed to a method for printing individual sheets in a printer or a copier, whereby a both-sided printing process on individual sheets ensues.

2. Description of the Related Art

High-performance printers can be operated in what is referred to as duplex mode, which is also called duplex color spot mode. In this operating mode, individual sheets are printed on both sides. When only one print ensues on the one side and two prints with different colors ensue on the other side, then this is called the duplex printing mode with three-fold printing. When respectively two prints ensue on both sides of the individual sheet, then this is called duplex printing mode with four-fold printing.

Various duplex printing systems with ate least two printing units are disclosed by U.S. Pat. No. 4,591,884 A. Another high-performance printer device with two printing units is disclosed by WO 91/13386 A1. It comprises two printing units and turnover channels for turning the individual sheets over. A transfer printing transport path is allocated to each printing unit.

When individual sheets are supplied such in such a high-performance printer device with two printing units that the spacing between two individual sheets is greater than the length of an individual sheet viewed in transport direction, then a safety margin is created between two individual sheets that allows a further individual sheet to be transferred in upon transport of the individual sheets in gaps between two successive individual sheets at intersections of the sheet transport paths. Given this procedure, however, the sheet throughput is relatively low due to the relatively large sheet spacings.

U.S. Pat. No. 5,159,395 discloses a printer device having only a single printing unit wherein spaces are likewise created between two successive sheets of a sheet stream in order to subsequently transfer further individual sheets into the sheet stream.

U.S. Pat. No. 5,337,135 discloses a further printer device with only a single printing unit wherein a first printing operating condition with a first, relatively close printing spacing is provided and a second operating condition with a second, larger sheet spacing [is provided], whereby following sheets are again transferred into an existing sheet stream in the second operating condition.

SUMMARY OF THE INVENTION

An object of the invention is to specify a method for printing individual sheets in a printer or in a copier in the duplex printing operating mode, whereby a high throughput of individual sheets given low wear and reduced risk of jams are achieved.

This object is achieved by the features of claim 1. Advantageous ddevs are recited in the dependent claims.

In the invention, the individual sheets are conducted in groups on the transport path within the printer. In this way, a slight spacing can be set between the individual sheets given transfer printing speed. The drive elements for the transport are not stressed by an additional start-stop mode, so that the wear on the overall transport system is reduced. The control outlay is also reduced since path and switching tolerances do not occur and corresponding buffer zones are not required. The throughput of individual sheets through the printer or, respectively, the copier is increased, since the group of individual sheets can be conducted with maximum speed on the transport path.

According to a further aspect of the invention, a method for printing individual sheets is recited wherein a predetermined plurality of single sheets have a predetermined distance from one another at transfer printing speed that is smaller than the length of an individual sheet as viewed in transport direction, the individual sheets of this group are supplied successively to a first printing unit for printing with a first color on the first side, the individual sheets of the first group are successively re-supplied, turned over, to the first printing unit for printing with the first color on the second side, and wherein, subsequently, the individual sheets of the group are supplied to the second printing unit for printing with the second color on the second side and are then output.

This aspect of the invention relates to the duplex printing mode with three-fold printing. The individual sheets are conducted past two printing units in groups in order to apply one print on one side and two differently colored prints on the other side. Given this aspect of the invention, too, the spacing between two individual sheets can be minimal and the transport speed can be maximum. A high throughput given low wear for the drive elements is thus achieved.

In a preferred exemplary embodiment of the invention, the first individual sheet of a following group of individual sheets is supplied following the last individual sheet of a preceding group of individual sheets after said preceding group has been supplied twice to the first transfer printing path. As a result of these measures, a throughput that is high overall is achieved given a multitude of individual sheets, since the spacing between the last individual sheet of a preceding group and the individual sheet of a following group can be kept slight.

Preferably, the path spacing between the last individual sheet of the preceding group and the first individual sheet of the following group is approximately the predetermined spacing.

According to a further exemplary embodiment of the invention, at least some of the individual sheets of the group are conveyed in alternation to the first ring and to the second ring via the connecting channel. In this way, the number of individual sheets of the group can be high since, due to the alternating conveying, individual sheets at the start of the group and individual sheets at the end of the group can be conveyed nearly simultaneously in the connecting channel and distributed onto both rings at the end of the conveying path in the connecting channel. A great number of individual sheets in a group leads to an improved utilization of the printing capacity offered by the two printing units.

In a preferred development, the alternating conveying of the individual sheets to the two rings and/or the transporting of the individual sheets into the proximity of the printing units ensues with increased speed compared to the transfer printing speed of the printing units. As a result of this increased conveying speed, the spacing between successive individual sheets of a group is enlarged. This spacing is used in order to convey individual sheets at the start of the group and individual sheets at the end of the group in alternation and distribute them onto the two rings.

A practical exemplary embodiment provides that, following the renewed pass of the individual sheets of the group past the first printing unit, these are output or the individual sheets are supplied to the second printing unit for printing with the second color on the second side and are then output. In the first version, a duplex printing mode with three-fold printing is realized, and a duplex printing mode with four-fold printing of the individual sheets is realized in the second version.

BRIEF DESCRIPTION OF THE DRAWINGS

Exemplary embodiments of the invention are explained below with reference to the drawing. Shown therein are.

DETAILED DESCRIPTION OF THE PREFERRED EMBODIMENTS

Figure 1:
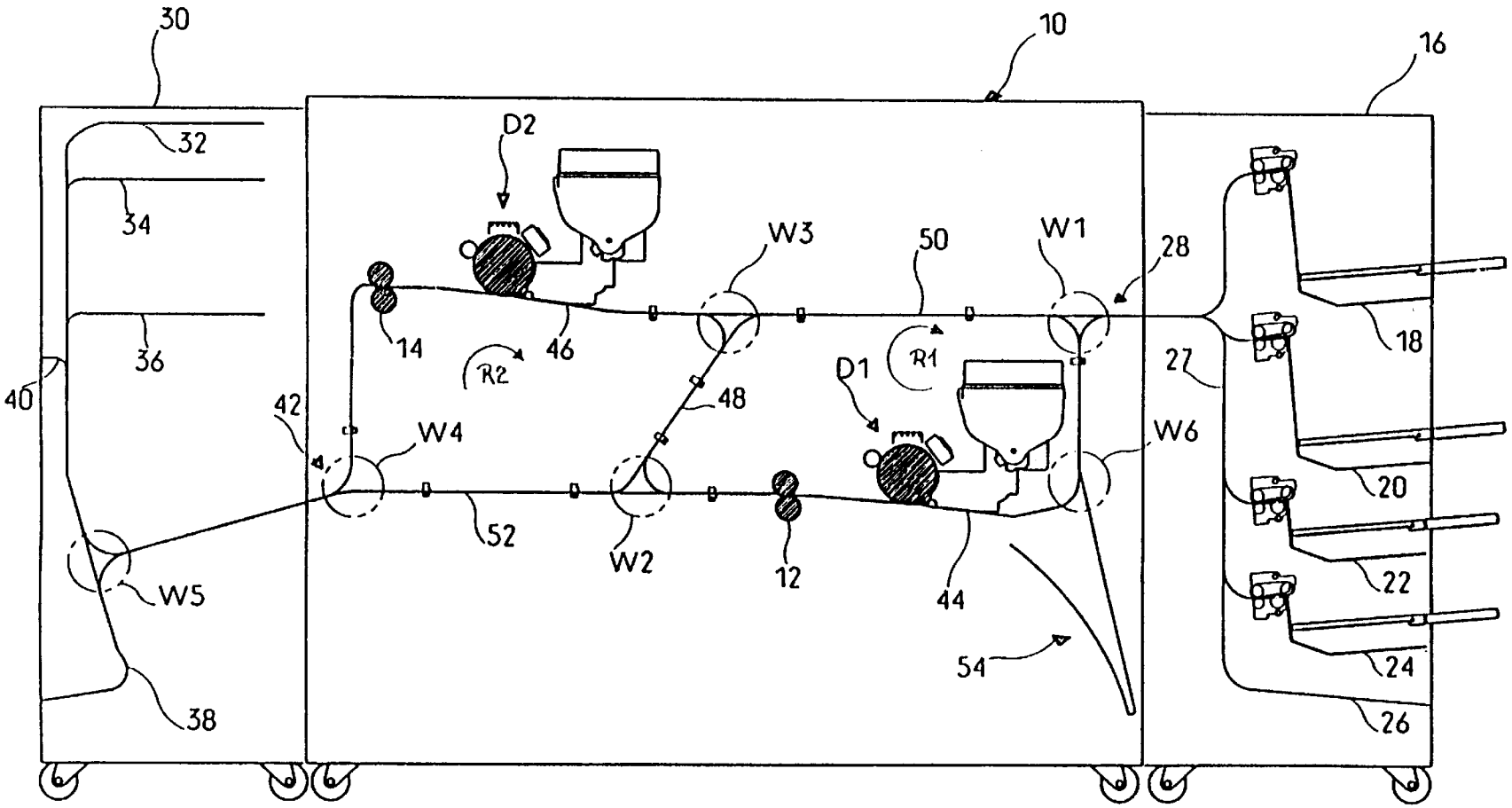
FIG. 1 the schematic structure of a high-performance printer wherein the invention is realized.
Figure 2:
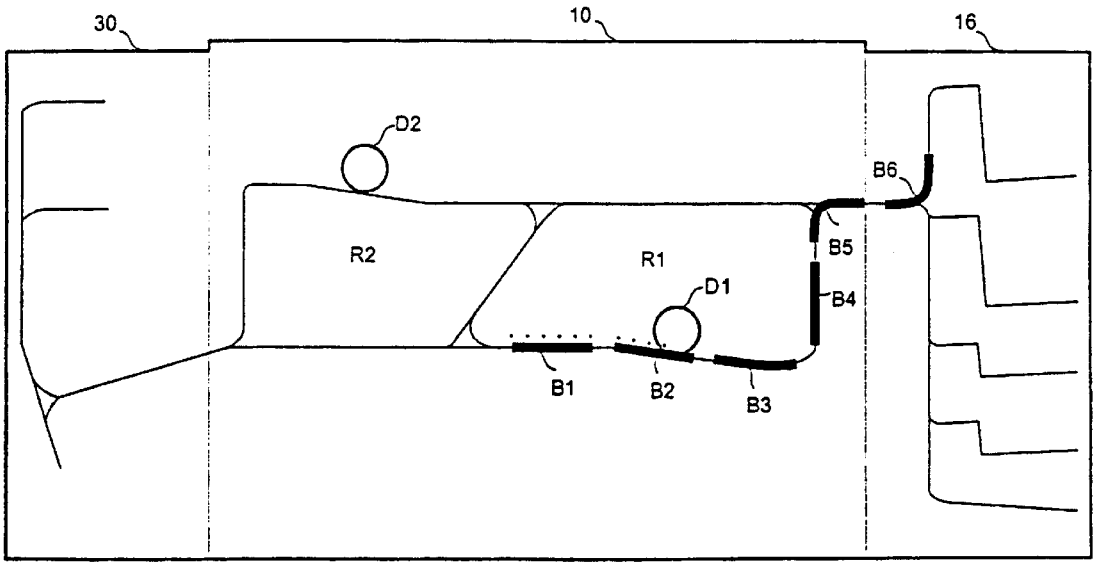
FIGS. 2–9 operating phases of the duplex printing mode with four-fold printing.

FIG. 1 shows a high-performance printer 10 that serves the purpose of fast printing of individual sheets of paper. The high-performance printer 10 contains a first, lower print unit D1 as well as a second, upper printing unit D2. The two printing units D1, D2 work according to the known electrographic method with the same transfer printing speed. The printing units D1, D2 are followed by fixing devices that are schematically indicated in FIG. 1 by two roller pairs 12, 14. A paper input 16 is connected to the high-performance printer 10, this containing a plurality of reservoirs 18 through 24 with individual sheets as well as an external paper input channel 26 via which individual sheets can be supplied by the outside. Individual sheets are supplied to an input section 28 via a transport channel 27. A paper output 30 that contains a plurality of output containers 32 through 36 is connected to the output side of the high-performance printer 10. Further, two output channels 38, 40 are provided via which individual sheets can be output to further-processing stations. The high-performance printer 10 outputs the printed individual sheets via the output section 42.

Transport paths for the transport of the individual sheets are arranged in the inside of the high-performance printer 10, various operating modes of the high-performance printer being realized on the basis of these transport paths. Respective transfer printing transport paths 44, 46 are allocated to the printing units D1, D2, these being respectively set such by drives that the supplied individual sheets have their transfer printing speed at the printing units D1, D2. Both transfer printing transport paths 44, 44 are connected to one another via a connecting channel 48. The transport path around the first printing unit D1 is supplemented by a delivery channel 50 to form a ring R1 via which individual sheets can also be supplied from the input section 28 to the second transfer printing transport path 46. The transport path for the second printing unit D2 is supplemented to form a ring R2 with a discharge channel 52 in a similar way, the individual sheets printed by the printing unit D1 being capable of being supplied to the output section 42 thereover.

A first shunt W1 that makes it possible that individual sheets from the input section 28 are optionally supplied to the first transfer printing transport path 44 or to the delivery channel 50 is arranged between the input section 28, the first transfer printing transport path 44 and the delivery channel 50. A further version is comprised therein that individual sheets transported on the delivery channel 50 in the direction of the shunt W1 can be supplied to the first transfer printing transport path 44.

Further, a second shunt W2 and a third shunt W3 are arranged at the ends of the connecting channel 48 and respectively connect the adjoining transport paths 44, 48, 52 or, respectively, 46, 48, 50. A fork shunt W4 is located in the proximity of the output section 42 and connects the adjoining transport paths. The paper output 30 contains a fifth shunt W5 that works as turn-over means. Further, an ejector means 54 should also be pointed out, reject individual sheets being supplied thereto via a shunt W6.

As a result of the arrangement described in FIG. 1, different operating modes of the high-performance printer 10 can be realized. These operating modes also include the operating modes of duplex printing mode with four-fold printing as well as the duplex printing mode with three-fold printing that are relevant here.

FIGS. 2 through 9 show various operating phases in the duplex printing mode with four-fold printing. For reasons of clarity, a plurality of components that were explained in the injunction with FIG. 1 have been omitted from the Figures. However, it can be easily seen how the operating sequences shown in FIGS. 2 through 9 are realized by the components shown in greater detail in FIG. 1.

As mentioned, the front side and the back side of the individual sheets are printed with image patterns of different colors in the duplex printing mode. Of course, it is assumed for this purpose that the printing units D1, D2 can print differently colored print images. In the first operating phase shown in FIG. 2, a group of six individual sheets B1 through B6 are drawn in via the input section 28 and the shunt W1 (respectively see FIG. 1 with respect thereto) and are conducted along the first transfer printing transport path 44 past the lower printing unit D1, whereby the first side is printed with a first color, indicated by dots. While the first individual sheet B1 has nearly reached the shunt W2 and the connecting channel 48, the last individual sheet B6 of the group is still in or, respectively, in front of the input section 28.

Figure 3:
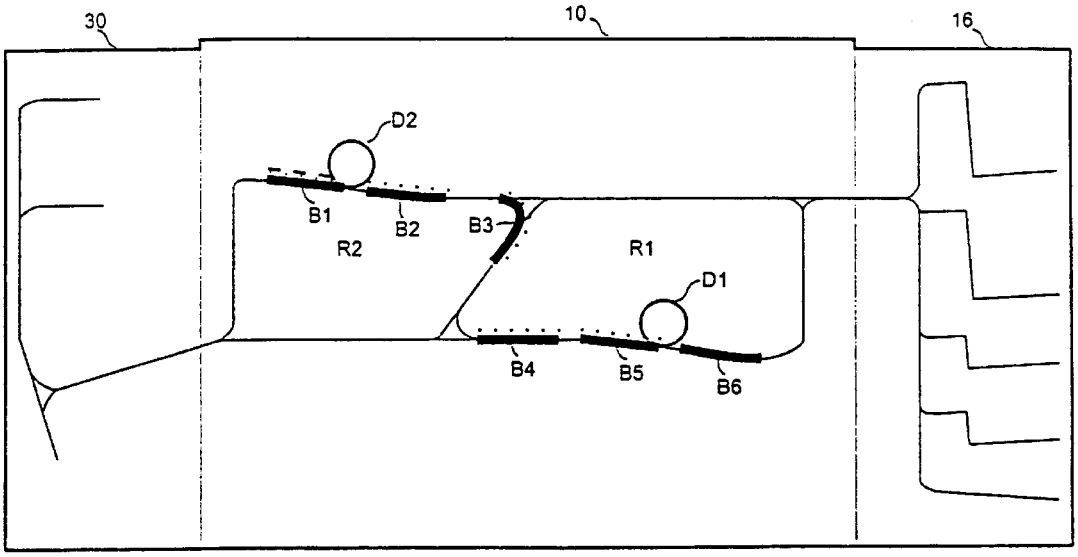

FIG. 3 shows that the sheets successively traverse the connecting channel 48 and are delivered via the second transfer printing transport path 46 to the second printing unit D2 for printing. Upon passage through the connecting channel 48, a higher transport speed than the transfer printing speed is preferably present in order to convey the individual sheets in an optimally short time on the distance between the two printing units D1, D2. Shortly before reaching the printing unit D2, the individual sheets B1 through B6 are in turn decelerated to transfer printing speed. A further print with a different color, for example red, is applied onto the side already printed by the printing unit D1 at the printing unit D2. This second printing event is identified in FIG. 3 by longitudinal strokes.

Figure 4:
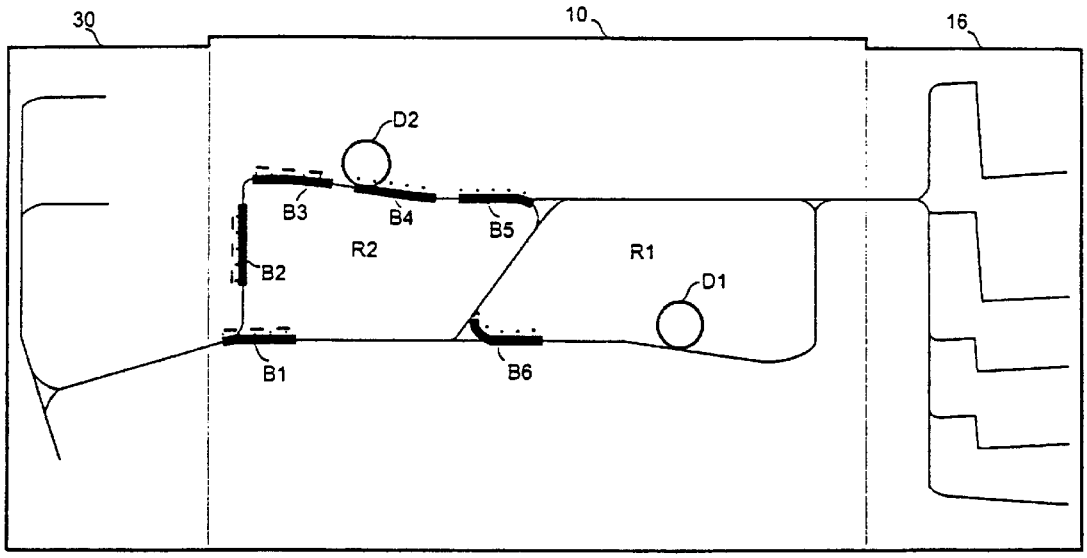

FIG. 4 shows the operating phase wherein the first individual sheet B1 is conveyed forward after being printed and has been turned over at the shunt W4 having turn-over function. Subsequently, the individual sheets B1 through B6 are successively conveyed again along the discharge channel 52 in the direction of the first printing unit D1. It must be noted that the sixth individual sheet B6 is still located at an adequate safety margin in front of the first sheet B1 on the path in the direction of the connecting channel 48.

Figure 5:
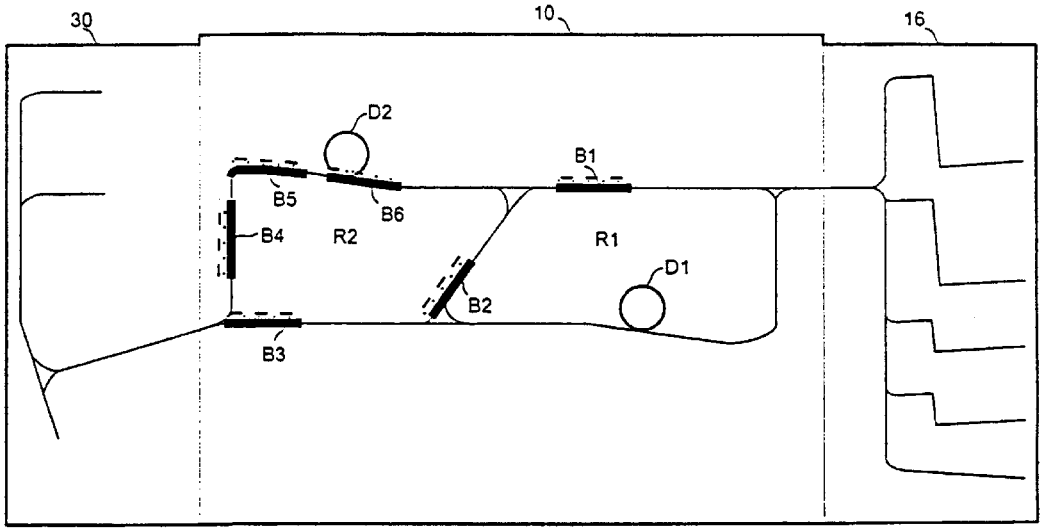

FIG. 5 shows the operating phase wherein the sixth individual sheet B6 is printed by the second printing unit D2, whereas the first individual sheet B1 has already traversed the connecting channel 48 and is now being conveyed along the delivery channel 50. All individual sheets B1 through B6 are turned over at the shunt W4.

Figure 6:
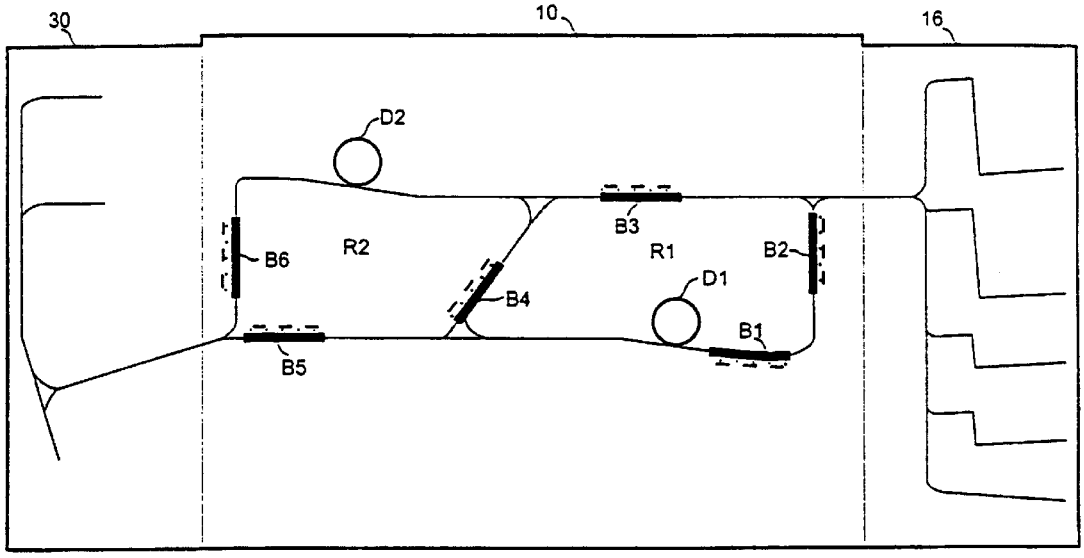

FIG. 6 shows the first individual sheet B1 shortly before the delivery to the first printing unit D1. The conveying speed for the individual sheet B1 is in turn set to the transfer printing speed. The further individual sheets B2 through B6 are still conveyed with increased speed.

Figure 7:
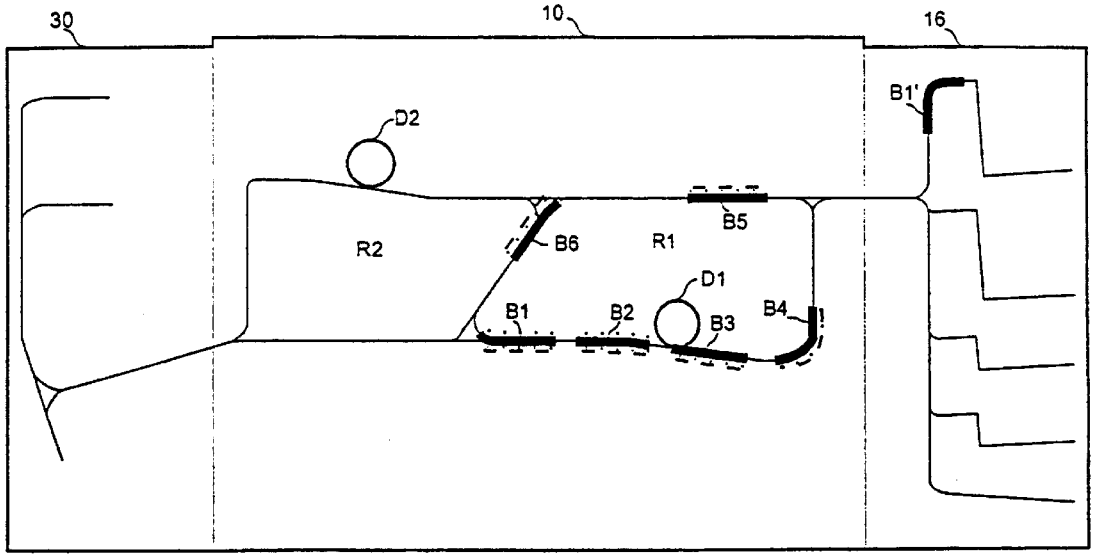

FIG. 7 shows that the individual sheets B1, B2 are printed for the third time, i.e. the first printing unit prints the other side of the individual sheets, indicated by dots in FIG. 7. The sixth individual sheet B6 is still situated in the connecting channel 48, but has an adequately great safety margin from the following individual sheet B1.

It can be seen at the right in the Figure that the first individual sheet B1 of the following group is already being supplied in the paper input 16 in order to be transferred into the first transfer printing transport path 44 at the shunt W1 following the passage of the individual sheet B6.

Figure 8:
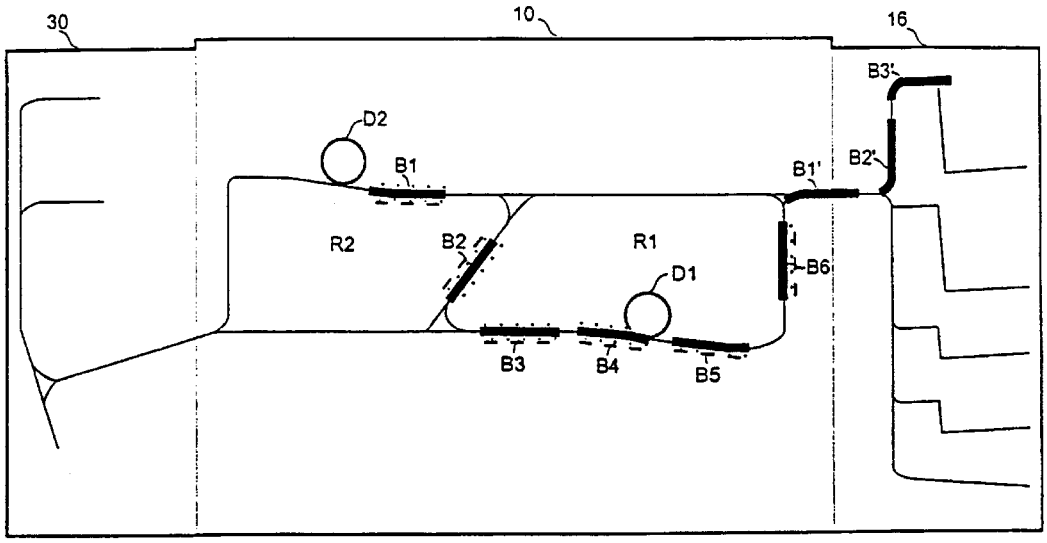

FIG. 8 shows the renewed delivery of the individual sheet B1 as well as of the further individual sheets B2 through B6 of the first group to the printing unit D2. The fourth print is applied at this printing unit D2. It can be seen at the right in the Figure that the individual sheets B1' B2', B3' of the following group at the shunt W1 are delivered to the first transfer printing transport path 44. The distance between the last individual sheet B6 of the first group and the first individual sheet B1 of the second group corresponds to the predetermined spacing a of the individual sheets at transfer printing speed.

Figure 9:
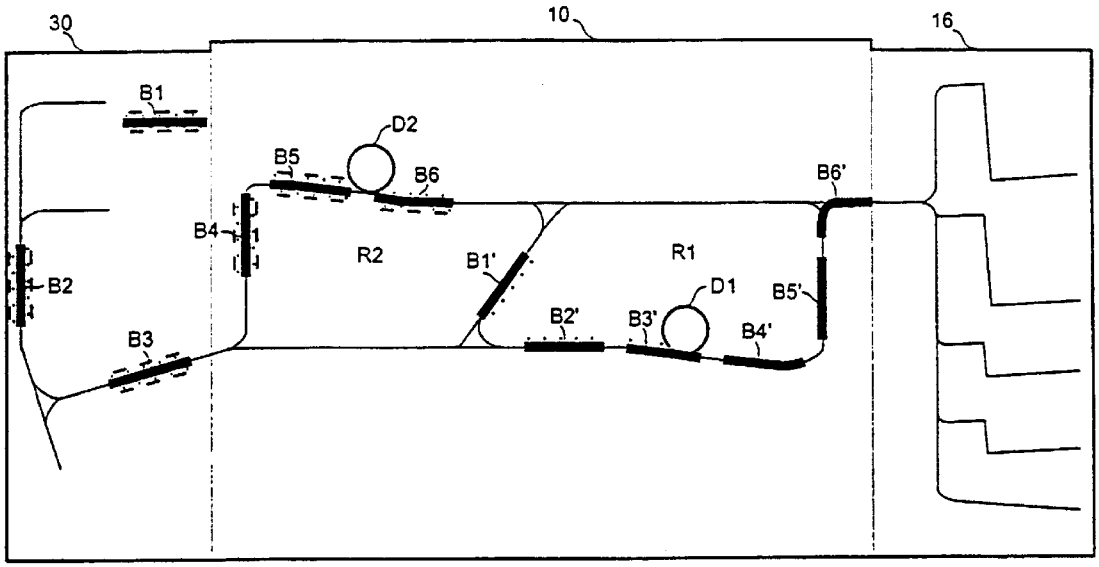

FIG. 9 shows an operating phase wherein the first group of individual sheets B1 through B6 are being printed by the second printing unit D2 (identified by horizontal strokes in FIG. 9) and are subsequently conveyed via the output section 42 into the paper output 30 and are deposited there at. The second group of individual sheets B1' through B6' is already is being subsequently printed by the first printing unit D1.

Various modifications for the group-by-printing of individual sheets in the duplex printing mode with four-fold printing are possible. Thus, the turnover need not necessarily ensue at the shunt W4 but can also be implemented at the shunts W2, W3 or, given suitable equipment at the shunt W1 as well, given the assumption that the appertaining drive elements can implement a turnover function. Let a turnover event be explained below with reference to the shunt W4. The respective individual sheet is first transported past the shunt W4 on a first transport path in a conveying direction in the direction of the shunt B5. Subsequently, the transport direction is reversed and the respective individual sheet is conveyed in the direction of the discharge channel 52. A similar functioning is possible for the further shunts W1, W2, W3.

Another modification is comprised therein in selecting the path of the group of individual sheets differently, for example in that the group is first supplied to the printing unit D2, then to the printing unit D1, is resupplied to the printing unit D2 after following turnover, is then supplied to the printing unit D1 and the individual sheets are then discharged via the discharge channel 52.

Figure 10:
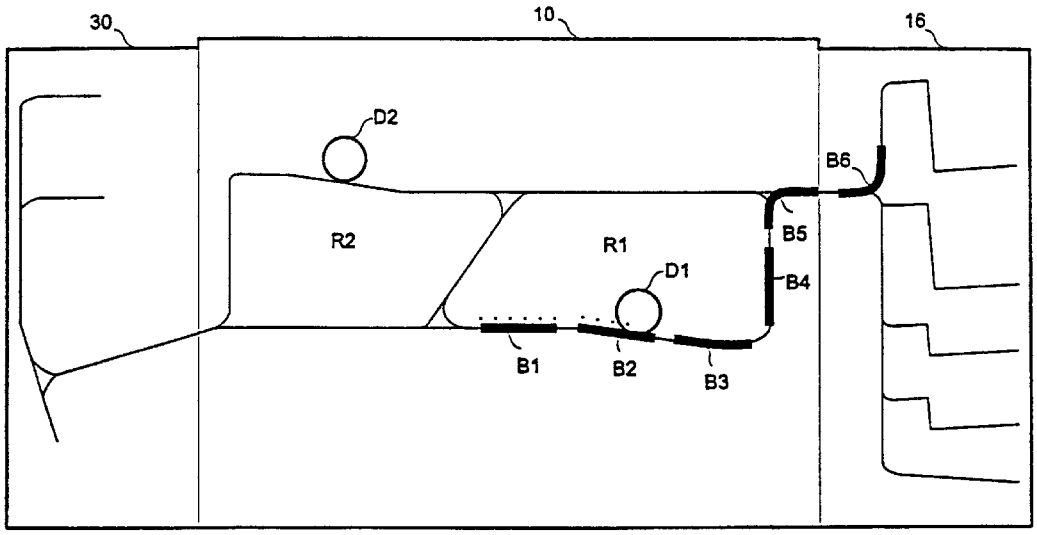
FIGS. 10–17 operating phases of the duplex printing mode with three-fold printing.

The duplex printing mode with three-fold printing is explained below with reference to FIGS. 10 through 17. FIG. 10 shows the delivery of the first group of individual sheets B1 through B6 from the paper input 16 to the first printing unit D1 that prints the individual sheets B1 through B6 with a first color (illustrated with dots), for example with a black color. The delivery speed can be higher than the transfer printing speed; however, this higher speed must be reduced to the transfer printing speed when the first printing unit D1 is reached.

Figure 11:
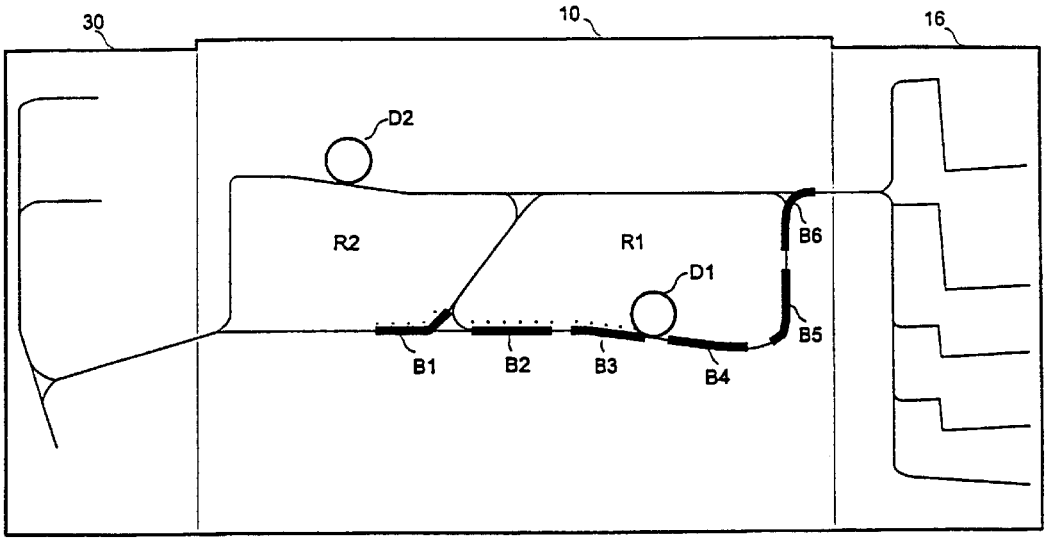

FIG. 11 shows the turnover of the individual sheets at the shunt W2 (see FIG. 1), whereby the individual sheet B1 is initially conveyed in the direction of the shunt W4, the conveying direction is then reversed, and the individual sheet B1 is transported in the direction of the connecting channel 48. A higher transport speed can again be selected when transporting outside the printing units D1, D2.

Figure 12:
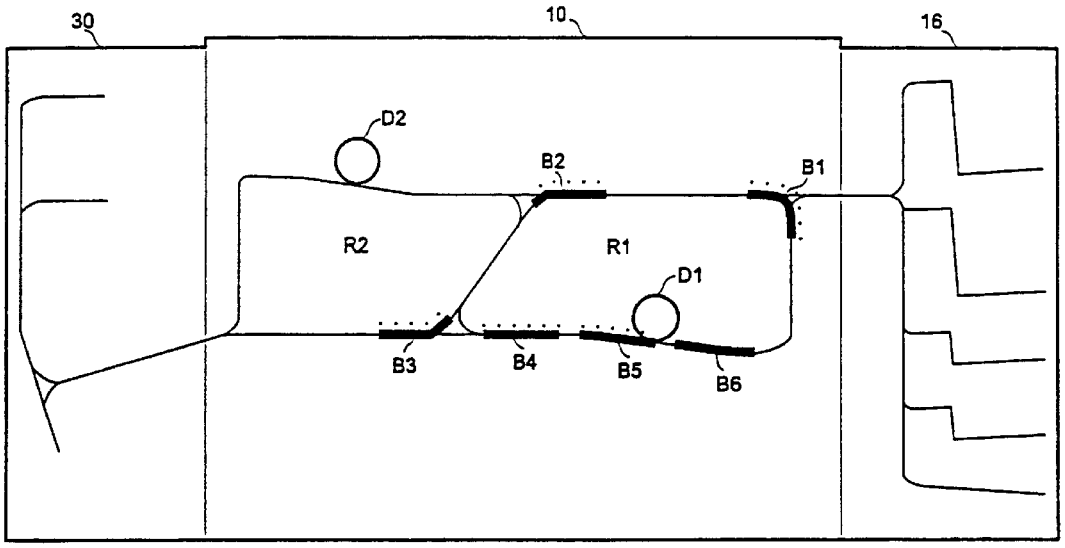

FIG. 12 shows that the individual sheets B1 through B6 are conveyed along the first, closed transport path R1.

Figure 13:
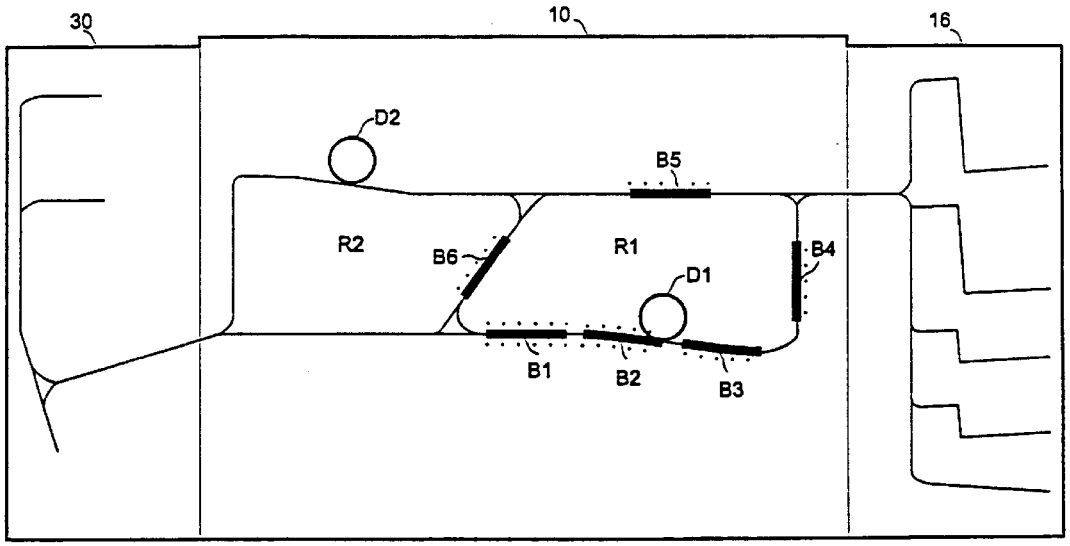

FIG. 13 shows the printing of the back side of the individual sheets B1 through B6 by the printing unit D1.

Figure 14:
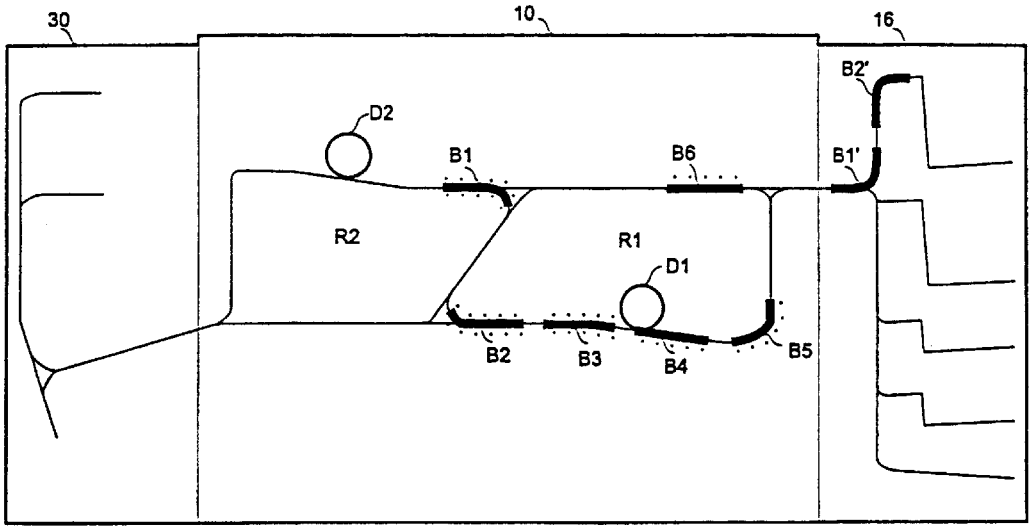

FIG. 14 shows the conveying of the individual sheets B1 through B6 via the connecting channel 48 to the second transport path 46, whereby no turnover ensues. It can be seen at the right in FIG. 14 that the individual sheets B1', B2' of the following group are already being offered via the paper input 16.

Figure 15:
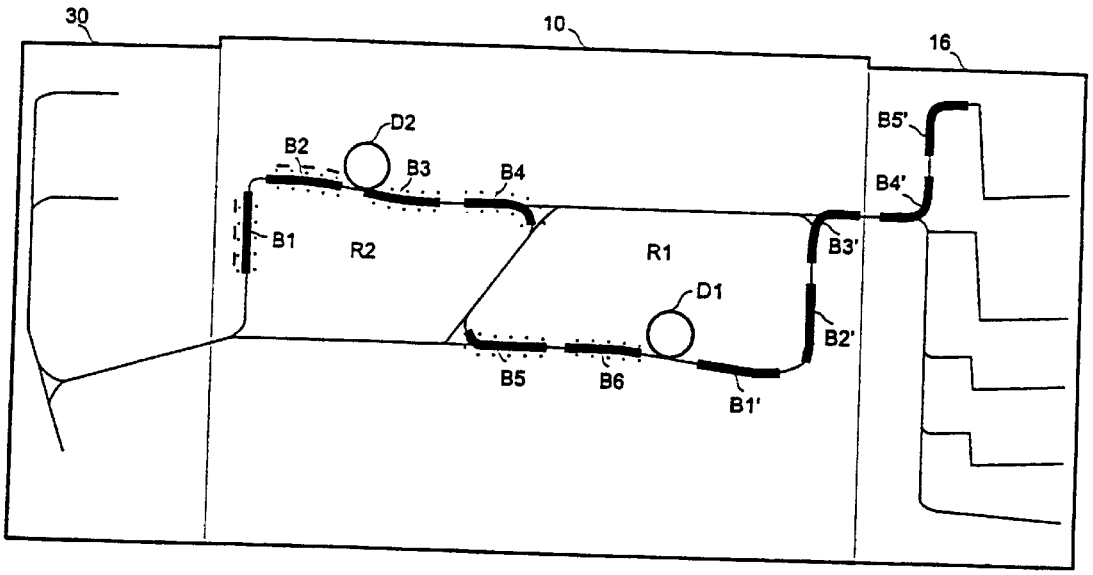

FIG. 15 shows the printing of the one side of the individual sheets B1 through B6 by the second printing unit D2. The individual sheets of the following group are already being supplied to the first printing unit D1, i.e. the first individual sheet B1' of the following group follows the last individual sheet B6 of the first group.

Figure 16:
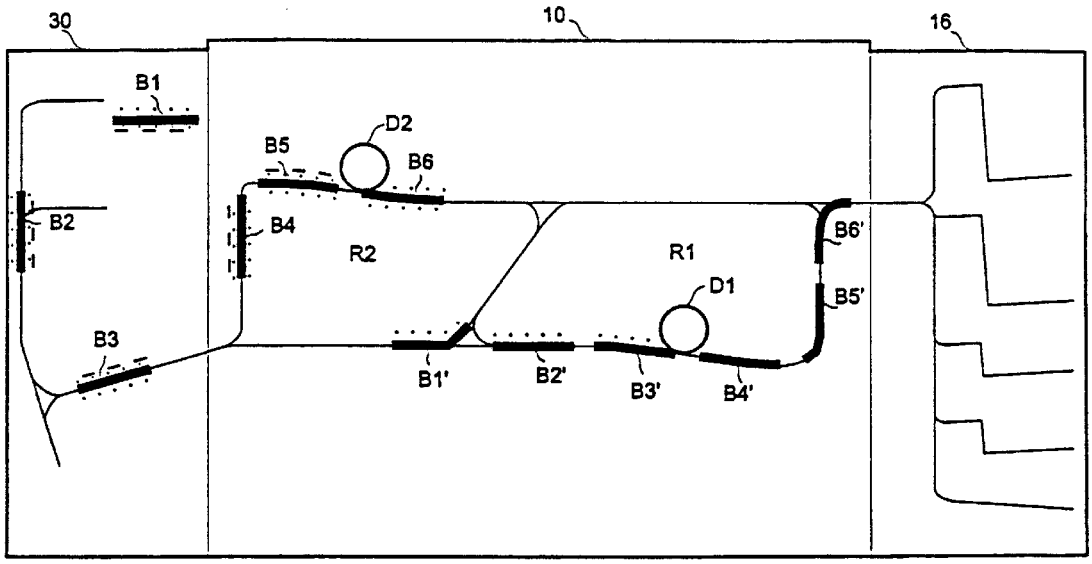

FIG. 16 shows the delivery of the individual sheets B1 through B6 of the first group into the paper output 30, whereby no turnover and what is referred to as a face-down deposit ensue. The individual sheets B1' through B6' of the following group are in an operating phase as shown in FIG. 11.

Figure 17:
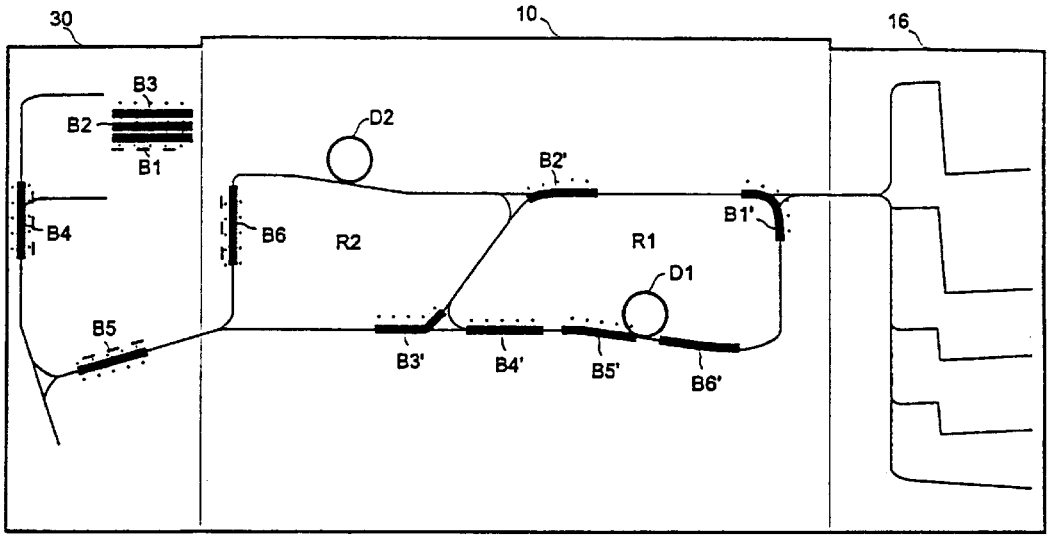
Figure 18:
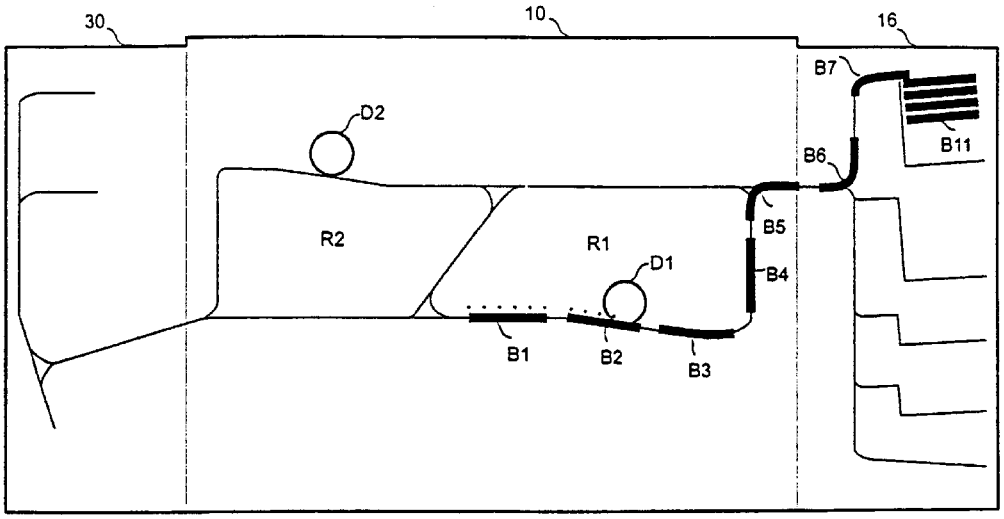
FIGS. 18–28 operating phases given four-fold printing and alternating delivery of individual sheets to the first or to the second transport ring.

FIG. 17 shows the further deposit of the individual sheets B1 through B6 of the first group and the printing of the individual sheets B1' through B6' of the following group.

A number of modifications are also conceivable given this duplex printing mode with three-fold printing. For example, the group of the individual sheets can be supplied first to the second printing unit D2 and printed a first time; then, the individual sheets are resupplied along the closed, second transport path R2 to the second printing unit D2, whereby the individual sheets have been previously turned over, for example in the shunt W4; then, the individual sheets are delivered without turnover to the first printing unit D1 via the connecting channel 48 and are printed. Subsequently, the individual sheets printed three times are output.

Various operating phases in the duplex printing mode with four-fold printing are shown in FIGS. 18 through 28, whereby individual sheets are conveyed in alternation to the first transport ring R1 or to the second transport ring R2. For reasons of clarity, a number of components that were explained in conjunction with FIG. 1 have been omitted from the Figures. However, it can be easily seen how the operating sequences shown in FIGS. 18 through 28 are realized by the components shown in the more detailed illustration of FIG. 1.

As mentioned, the front side and the back side of the individual sheets are printed with image patterns of different colors in the duplex printing mode. Of course, it is assumed for this purpose, that the printing units D1 and D2 can print differently colored print images. In the first operating phase shown in FIG. 18, a group of eleven individual sheets B1 through B11 from the paper input 16 are drawn in via the input section 28 and the shunt W1 (see respectively FIG. 1 for this purpose) and are conducted past the lower printing unit D1 along the first transfer printing path 44, whereby the first side is printed with a first color, indicated by dots. Whereas the first individual sheet B1 has nearly reached the shunt W2 and the connecting channel 48, the last individual sheet B11 of the group is still located in front of the input section 28 in the paper input 16.

Figure 19:
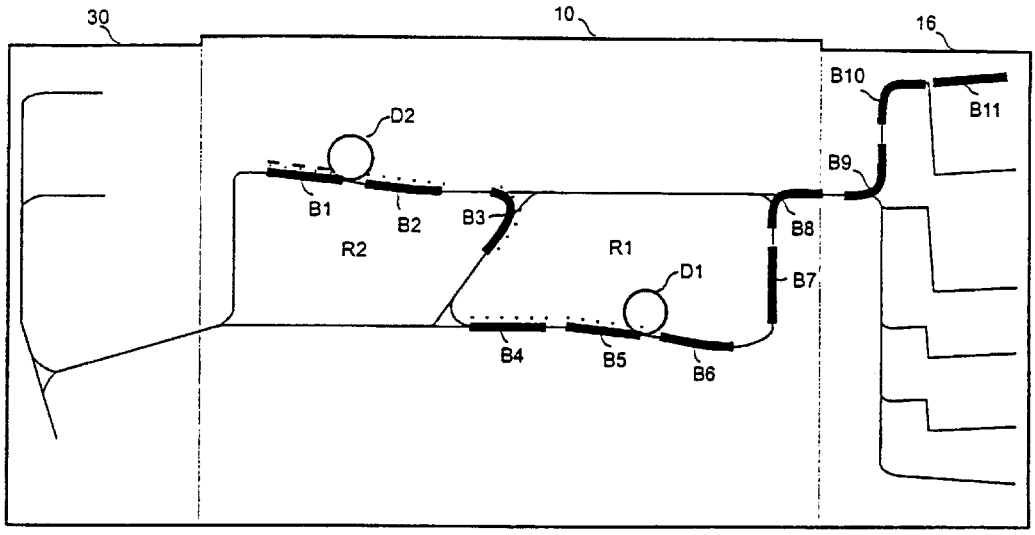

FIG. 19 shows that the individual sheets successively traverse the connecting channel 48 and are delivered via the second transfer printing transport path 46 to the second printing unit D2 for printing. When passing through the connecting channel 48, a higher transport speed is present than the transfer printing speed in order to convey the individual sheets in the shortest possible time on the path between the two printing units D1, D2. Shortly before reaching the printing unit D2, the individual sheets B1 through B11 are in turn decelerated to the transfer printing speed. A further print with a different color, for example red, is applied onto the side already printed by the printing unit D1, being applied at the printing unit D2. This second printing event is identified in FIG. 3 by longitudinal strokes.

Figure 20:
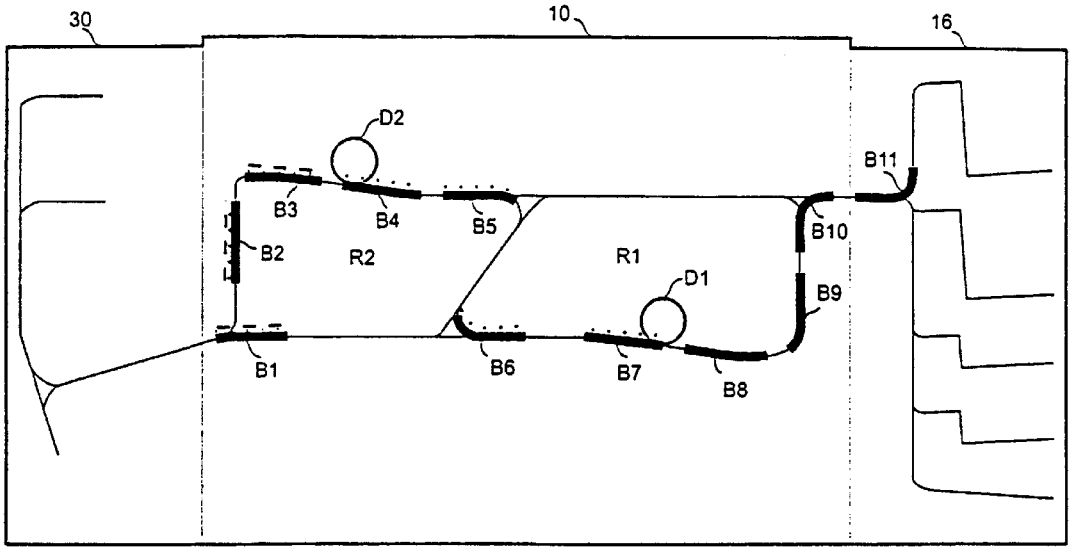

FIG. 20 shows the operating phase wherein the first individual sheet B1 is further-conveyed after having been printed and has been turned over at the shunt W4 with turnover function. Subsequently, the individual sheets B1 through B11 are in turn successively conveyed in the direction of the first printing unit D1 within the ring R2 along the discharge channel 52. It must be noted that the eleventh individual sheet B11 is still in the unprinted condition preceding the input section 28 and the individual sheet B6 as well as the following individual sheets B7, B8, B9 have not yet past through the connecting channel 48.

Figure 21:
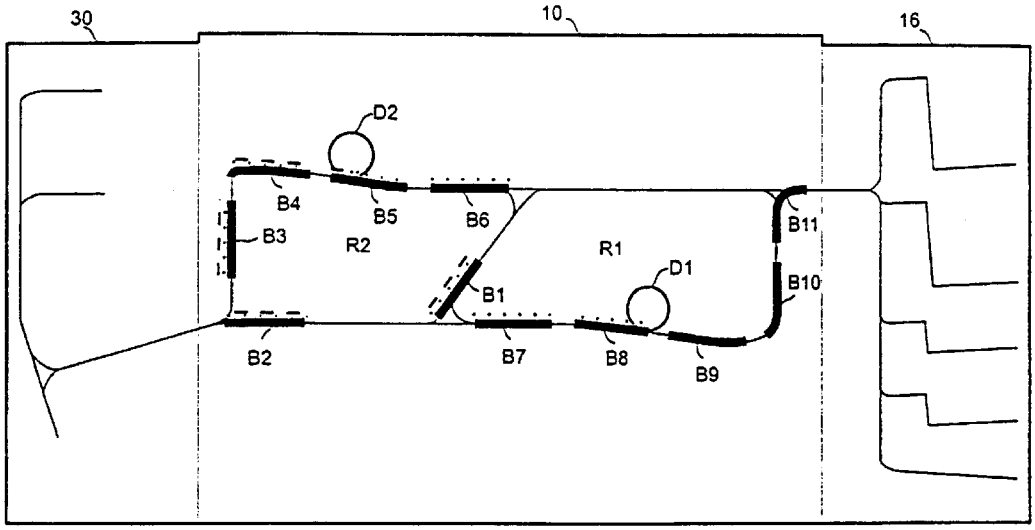

FIG. 21 shows an operating phase wherein the first individual sheet B1 at the shunt W2 is threaded in between the individual sheets B6 and B7 and is conveyed upward in the connecting channel 48. As mentioned, the individual sheets B1 through B11 are conveyed with a speed higher than the transfer printing speed after leaving the printing unit D1, being conveyed to the printing unit D2. As a result thereof, the distance between the individual sheets increases. This distance is utilized in the invention for threading the individual sheets in that derive from the printing unit D2 and are arranged at the start of the group.

Figure 22:
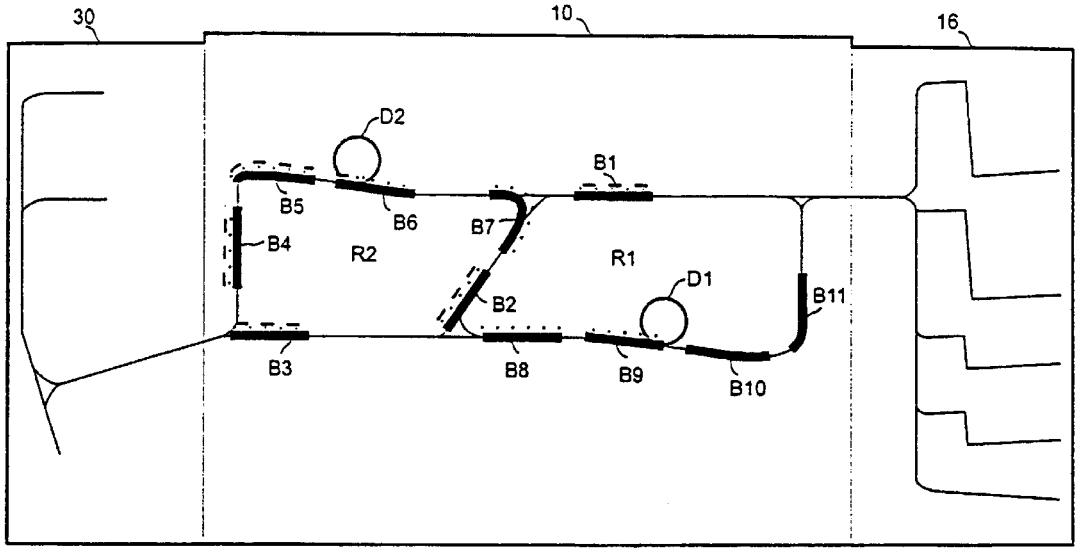

FIG. 22 shows the operating condition wherein the individual sheet B1 is conveyed in the direction of the first printing unit D1 after leaving the turnover W3. The individual sheet B6, by contrast, has been conveyed in the print direction of the printing unit D2. The following individual sheets B7 is just being redirected by the shunt W3 in the direction of the printing unit D2. The individual sheet B2 has been threaded in between the individual sheets B7 and B8 and is conveyed up in the connecting channel 48.

Figure 23:
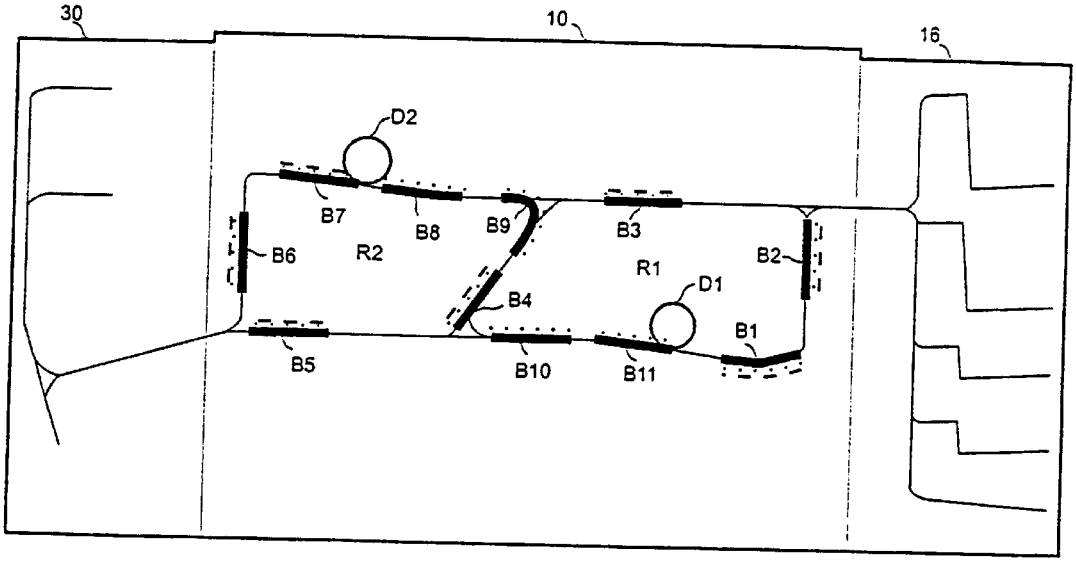

FIG. 23 shows the first individual B1 shortly before delivery to the first printing unit D1. The conveying speed for the individual sheet B1 is again set to the transfer printing speed. The further individual sheets B2, B3, B4 in the ring R1 are still being conveyed with increased speed. The individual sheet B4 has been inserted between the individual sheets B9 and B10 at the shunt W3.

Figure 24:
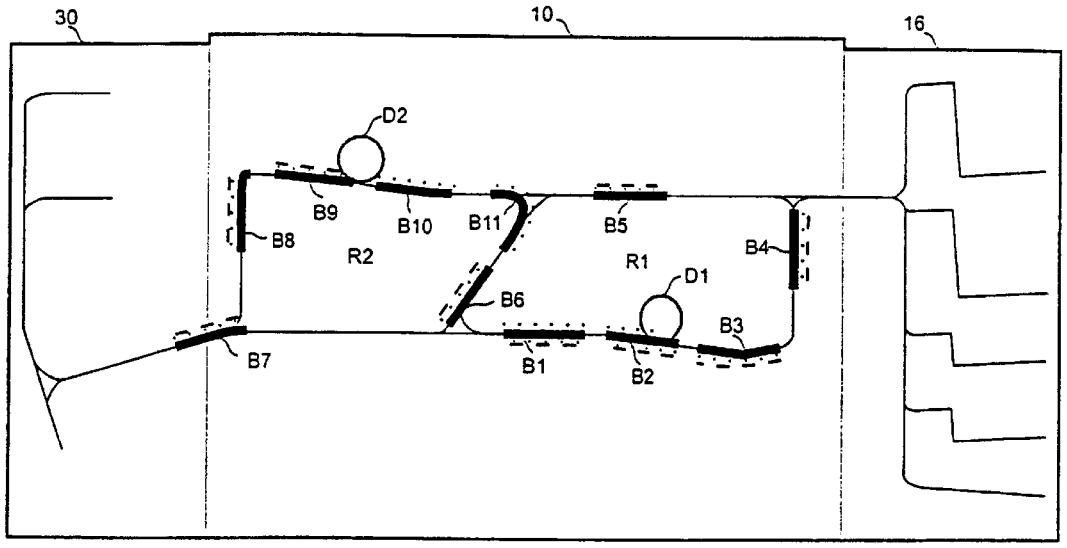

FIG. 24 shows that the individual sheets B1 and B2 are being printed for the third time, i.e. the first printing unit D1 prints the other side of the individual sheets, illustrated in FIG. 8 by dots. The eleventh individual sheet B11 is still located in the connecting channel 48 and is redirected in the direction of the printing unit D2 for printing. The individual sheet B6 is inserted between the individual sheets B11 and B1 and is conveyed up in the connecting channel 48.

Figure 25:
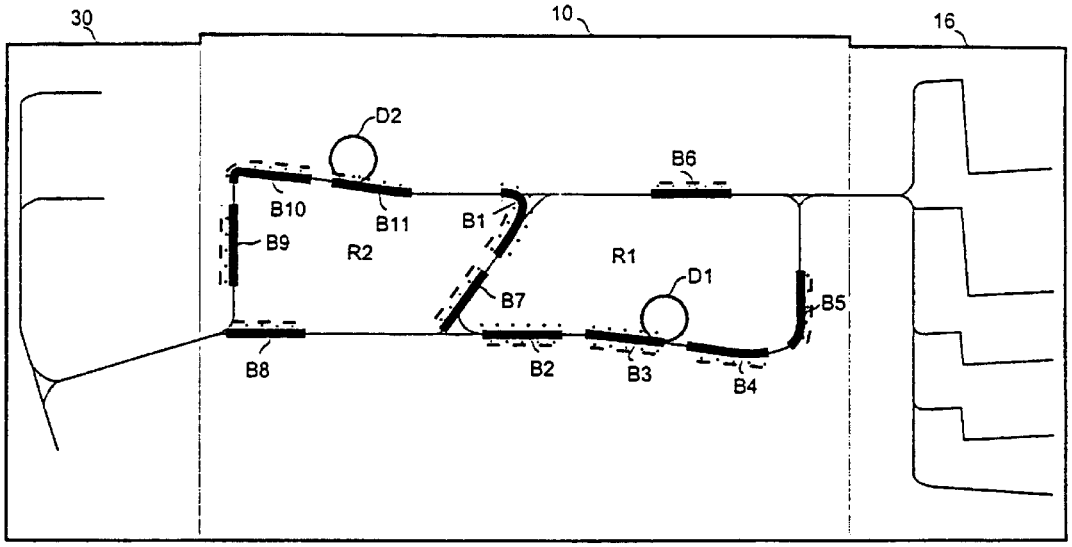

FIG. 25 show the renewed delivery of the individual sheet B1 as well as of the further individual sheets B2 and the following sheets B3 through B11 of the first group to the printing unit D2. The individual sheet B7 is inserted between the individual sheets B1 and B2 in the connecting channel 48.

Figure 26:
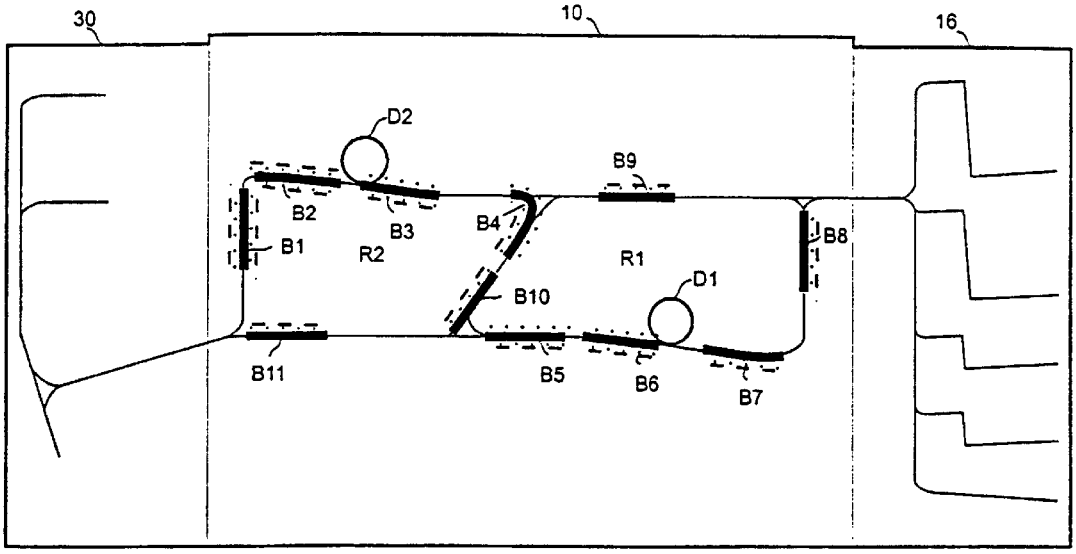

FIG. 26 shows the operating phase wherein a first portion of the individual sheets B1, B2, B3 of the first group is printed by the second printing unit D2, indicated by horizontal strokes. The individual sheets B10, B11 are inserted between the individual sheets B4 and B5 or, respectively, B5 and B6 in the connecting channel in the fashion of a zipper system.

Figure 27:
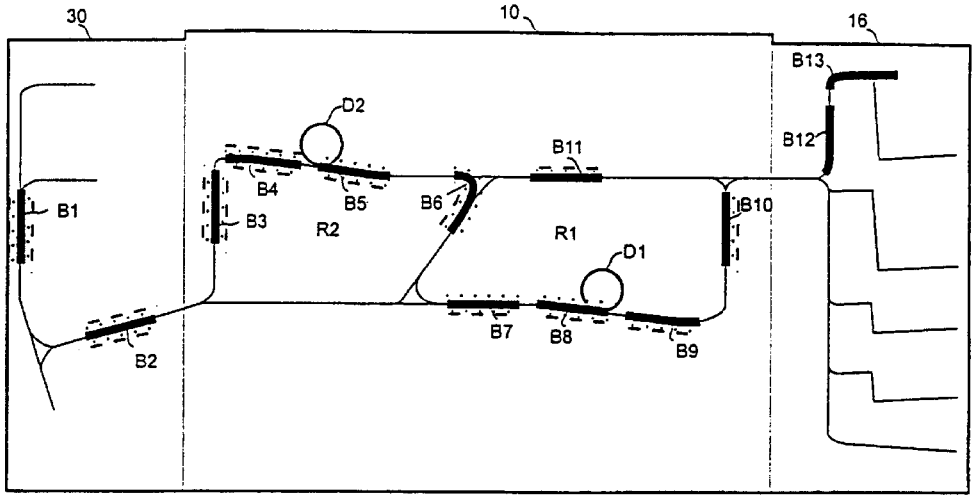

FIG. 27 shows that the individual sheets provided with a fourth print image, for example the individual sheets B1, B2, are conveyed via the output section 42 into the paper output 30 and are deposited thereat. A following group of individual sheets B1' through B11' is conveyed out of the paper input 16. The individual sheet B1' immediately follows the last individual sheet B11 of the first group . The group of individual sheets B1' through B11' then passes through the high-performance printer in the way described for the first group of individual sheets B1 through B11.

Figure 28:
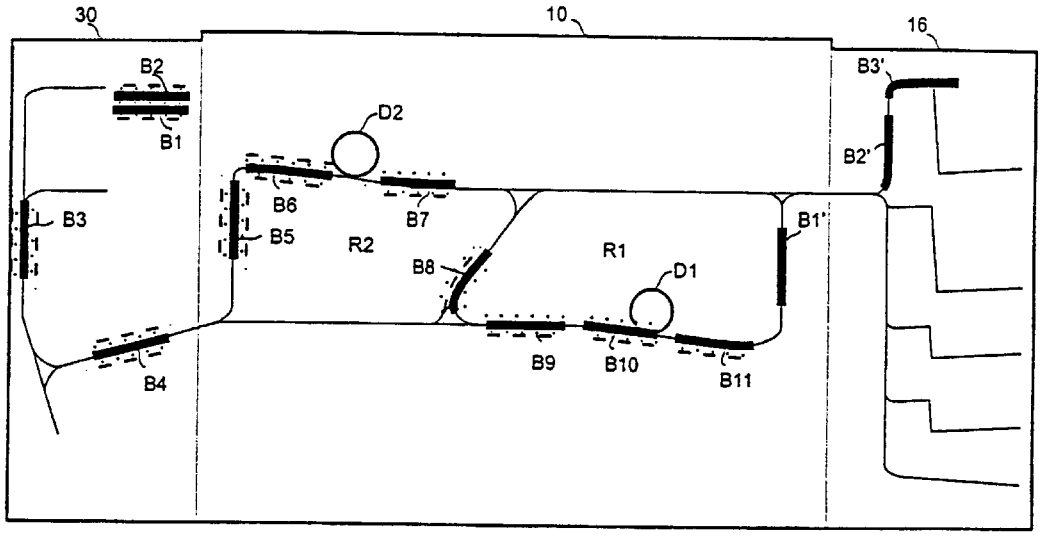

FIG. 28 shows the common transport of individual sheets B3 through B11 of the first group as well as of individual sheets B1', B2' and B3' of the following, second group. Both printing units D1 and D2 are utilized to nearly 100% given the illustrated operating mode.

Numerous modifications for the group-by-group printing of individual sheets in the duplex printing mode with four-fold printing are possible. Thus, the turnover need not necessarily ensue at the shunt W4 but can also be carried out at the shunts W2, W3 or, given suitable equipment, at the shunt W1 as well, given the assumption that the appertaining drive elements can implement a turnover function. Let a turnover function be explained below with reference to the shunt W4. The respective individual sheet is first transported past the shunt W4 on a first transport path in a conveying direction in the direction of the shunt W5. Subsequently, the transport direction is reversed and the respective individual sheet is conveyed in the direction of the discharge channel 52. A similar functioning is possible for the further shunts W1, W2, W3.

Another modification is comprised in selecting the path of the group of individual sheets differently, for example in that the group is first supplied to the printing unit D2, then to the printing unit D1, re-supplied to the printing unit D2 after subsequent turnover, then the printing unit D1, and the individual sheets are output via the discharge channel 52.

The duplex printing mode with three-fold printing is explained below with reference to FIG. 1. The group of individual sheets in this operating mode first passes through the first transfer printing transport path 44, then the connection channel 48, the second transfer printing transport path 46, the discharge channel 52, again traverses the connecting channel 48, the delivery channel 50 and the first transfer printing transport path 44 and is then output in the output section 42. Upon return of the individual sheets printed by the second printing unit D2 to the first printing unit D1, individual sheets are threaded in at the shunt W2 in the described way and are supplied at the shunt W3 either to the first ring R1 or to the second ring R2.

As can be seen with reference to the exemplary embodiment according to FIGS. 1 and 18 through 28, what is achieved given group-by-group printing of the individual sheets is that the first printing unit D1 has 100% usage, i.e. Interruption-free printing operation exists for the printing unit D1.

The maximum number of individual sheets of a group is dependent on the overall length of the transport path in the printing system. The predetermined number of individual sheets of a group derives according to $$N \leq INT\left\{\frac{L_{44} + L_{46} + L_{48} + L_{50} + L_{52}}{L_B + a}\right\},$$

whereby $L_{44}$ is the length of the first transfer printing transport path 44, $L_{46}$ is the length of the second transfer printings transport path 46. $L_{48}$ is the length of the connecting channel 48, $L_{50}$ is the length of the delivery channel 50, $L_{52}$ is the length of the discharge channel 52, $L_B$ is the length of the individual sheet viewed in transport direction, and A is the distance between two successive individual sheets at transfer printing speed.

Claim 19 describes a further calculating method for determining the maximum number of individual sheets of a group. The threading of the individual sheets into the connecting channel 48 can ensue triggered or untriggered. Given the untriggered operating mode, the individual sheets deriving from the ring R2 are threaded into the connecting channel 48 without arresting the individual sheets. Given the assistance of FIG. 1 and FIGS. 20 and 21, this untriggered operating mode shall be explained in greater detail. As mentioned, the individual sheet B1 is threaded in between the individual sheets B6 and B7 in the connecting channel and is conveyed up and is then supplied to the printer D1, whereas the individual sheets B6 and B7 are supplied to the printing unit D2 (see FIGS. 20 and 21). In the untriggered operating mode, the distance between the individual sheets following the individual sheet B6 is then dimensioned of such a size that the individual sheet B1 to be threaded in is conveyed on the transport path 52 with a defined speed and can thread in between the individual sheets B6 and B7 without being arrested. The speed of the individual sheets on the transport path from the shunt W4 up to the shunt W6, where the speed is in turn reduced to the transfer printing speed, remains approximately constant given this operating mode.

On the common path segment of the connecting channel 48, the individual sheet B1 threads between the individual sheets B6 and B7, the individual sheet B2 threads between the individual sheets B7 and B8, the individual sheet B3 threads between the individual sheets B8 and B9 in succession, etc. The shunt W3 is actuated at every individual sheet upon departure of the individual sheets in order to deliver the successive individual sheets in alternation to the first or to the second printing unit D1 or D2.

The individual sheet B1 and the following individual sheets, for instance from the shunt W6 up to the shunt W2, are transported with transfer printing speed, are printed for a third time at the printing unit D1 and thread between the individual sheets B6 and B7 as well as the following individual sheets that have a corresponding distance from one another. After the threading at the shunt W2, the individual sheets B1 and the following individual sheets are conveyed to the printing unit D2 with elevated speed. After leaving the upper printing unit D2, the individual sheets are again transported with elevated speed via the shunt W4 in the direction of the paper output 30. At the shunt W5, the individual sheets are optionally turned over in order to be able to deposit them in the output compartments 32, 34, 36 face down or face up. In the interim, the last individual sheets B11 of the first group of individual sheets has past the common path segment in the connecting channel 48, and the first individual sheet B1' of the following group of elevens can be drawn in. The stream of individual sheets is thus closed.

In the untriggered operating mode, the advantage of the employment is comprised therein that no particular control outlay is required when threading in at the shunt W2. On the contrary, the return transport of the individual sheets from the upper printing unit D2 to the lower printing unit D1 can ensue with constant speed. What is disadvantageous is that tolerances in the distances between the individual sheets within the group cannot be compensated and, thus, a backup upon thread-in can arise.

The triggered operating mode is explained below. According to FIGS. 20 and 21, the individual sheet B1 to be delivered from the printing unit D2 to the printing unit D1 is to be threaded in between the individual sheets B6 and B7 at the shunt W2. Given this operating mode, the distance between the individual sheets B6 and B7 as well as the following individual sheets is equal to the shortest nominal spacing. The individual sheet B1 is transported in the direction of the shunt W2 with such a high speed after leaving the shunt W4 with turnover function that it arrives adequately early in front of the shunt W2, preferably before the individual sheet B6 has past the shunt W2. At this shunt W2, the individual sheet B2 is briefly arrested or is decelerated The continued transport of the individual sheet B1 is then triggered by the individual sheet B6. Preferably, a signal is generated when the trailing end of the individual sheet B6 leaves, this signal initiating the transport of the individual sheet B1 into the connecting channel 48, preferably at the same speed with which the individual sheet B6 is being conveyed. The individual sheet B1 thus threads between the individual sheets B6 and B7 with the same elevated speed as the transport speed of the individual sheet B6 in the connecting channel 48. Shortly before the individual sheet B7 reaches the first drive roller pair in the connecting channel 48, this roller pair and the one following thereupon in the connecting channel 48 is reduced in transport speed to the transfer printing speed, since the individual sheet B7 is still partially located in the region of the first printing unit D1, for example in the decurler. Accordingly, the individual sheet B1 is reduced in speed to the speed of the individual sheet B7. When the individual sheet B7 leaves the printing region, preferably the region of the decurler, in the printing unit D1, it can again be transported with elevated speed. The individual sheet B1 is then also transported forward with elevated speed and proceeds to the transport path 50. The individual sheet B1 is transported with constantly elevated speed up to the region at the shunt W6 and is then stepped down to transfer printing speed. The point-in-time of the reduction of the transport speed of the individual sheet B1 can be matched to the preceding individual sheet B11. The gap between the end of the individual sheet B11 and the start of the individual sheet B1 can then be set to a nominal spacing or slightly greater. The further individual sheets B2, B3, etc., within the group of eleven individual sheets are transported in a similar way as was set forth for the individual sheet B1.

Given the triggered operating mode, a controlled threading ensues at the shunt W2. The back-up risk during threading is thus reduced, and the distance between the individual sheets can be minimized. What is disadvantageous is the increased outlay for regulation and control during thread-in.

Up to now, the duplex printing mode has been described, whereby a predetermined number of individual sheets, preferably eleven, are combined to form a group and this group is printed on both sides by the printing units D1 and D2. Another operating mode not covered by the attached claims is possible wherein no group-by-group transport of the individual sheets ensues; rather, a continuous delivery of individual sheets occurs. This operating mode is called continuous operating mode. In this continuous operating mode, only every second individual sheet is drawn in from the paper input 16, the distance between two successive, drawn-in individual sheets is identical to the respective sheet length plus the nominal spacing. The gaps arising in this way between the individual sheets are successively filled by preceding individual sheets that have already been printed twice. In this way, a continuous individual stream is produced and the printing units D1, D2 are optimally utilized. So that the sheets can be threaded in controlled fashion at the shunt W2, a second transport control path in the region of the shunt W1 is required in addition to a transport control path in the region of the shunt W2. The sequences and transport speeds of the individual sheets from the input 16 up to the shunt W4 coincide with those that were described in the untriggered mode.

Although other modifications and changes may be suggested by those skilled in the art, it is the intention of the inventors to embody within the patent warranted hereon all changes and modifications as reasonably and properly come within the scope of their contribution to the art.

What is claimed is:

1. A method for printing individual sheets in a printer or in a copier, comprising the steps of:

combining a predetermined number of individual sheets into a group, the individual sheets having a predetermined spacing from one another at transfer printing speed that is less than a length of an individual sheet as viewed in a transport direction;

successively supplying the individual sheets of said group to a first printing unit for printing with a first color on a first side;

subsequently successively supplying the individual sheets of the group to a second printing unit for printing with a second color on the first side;

turning over the sheets; and successively re-supplying the individual sheets of the group to the first printing unit for printing with the first color on a second side.

2. A method according to claim 1, further comprising the steps of:

supplying the individual sheets of the group to the second printing unit for printing with the second color on the second side; and outputting the sheets.

3. A method according to claim 1, further comprising the step of:

retaining a distance between the individual sheets at the printing units during transport of the group of individual sheets.

4. A method according to claim 1, wherein said step of successively supplying supplies the group of individual sheets to the first printing unit from an input section via a first transfer printing transport path to which a connecting channel connects and via which the individual sheets are supplied to a second transfer printing transport path for the second printing unit; and further comprising the steps of:

discharging the second transfer printing transport path into an output section;

providing a discharge channel for transport of the single sheets between the output section and one end of the connecting channel; and providing a delivery channel between the input section and an other end of the connecting channel.

5. A method according to claim 4, wherein the group of individual sheets first traverse the first transfer printing transport path, then the connecting channel, the second transfer printing transport path, the discharge channel, again traverse the connecting channel, the delivery channel, the first transfer printing transport path, the connecting channel and the second transfer printing transport path and are then output at the output section.

6. A method according to claim 4, wherein the input section contains a first shunt that supplies the individual sheets either from the input section or from the delivery channel to the first transfer printing transport path.

7. A method according to claim 4, further comprising the step of:

providing a second shunt at a junction between the first transfer printing transport path and the connecting channel providing a third shunt at a junction of second transfer printing transport path and the connecting channel.

8. A method according to claim 7, further comprising the step of:

providing a fourth shunt between second transfer printing transport path and discharge channel.

9. A method according to claim 8, wherein one of said second shunt and the third shunt and the fourth shunt carries out a turnover function so that the individual sheet is turned over.

10. A method according to claim 9, wherein said turning over includes:

transporting the individual sheet past one of said first second and third shunts on a first transport path in a first transport direction into a turnover section;

subsequently reversing the transport direction; and conveying the individual sheet to a second transport path in the reverse transport direction.

11. A method according to claim 4, wherein after the group of individual sheets has been supplied twice to the first transfer printing transport path, supplying a first individual sheet of a following group of individual sheets following a last individual sheet of the group.

12. A method according to claim 11, wherein a path spacing between the last individual sheet of the preceding group of individual sheets and the first individual sheet of the following group approximately corresponds to the predetermined spacing.

13. A method according claim 4, wherein the first transfer printing transport path, the connecting channel and the delivery channel form a first closed transport path.

14. A method according to claim 4, wherein the second transfer printing transport path, the connecting channel and the discharge channel form a closed, second transport path for individual sheets.

15. A method according to claim 13, wherein the first closed transport path and the second closed transport path are of essentially a same length.

16. A method according to claim 4, wherein the predetermined number of individual sheets of a group derives as $$N \leq INT\left\{\frac{L_{44} + \quad + L_{48} + L_{50}}{L_B + a}\right\},$$

where $L_{44}$ is a length of the first transfer printing transport path, $L_{48}$ is a length of the connecting channel, $L_{50}$ is a length of the delivery channel, $L_B$ is a length of the individual sheet as viewed in transport direction and a is a spacing between two successive individual sheets at transfer printing speed.

17. A method according to claim 16, wherein for individual sheets in DIN A4 format with a short side in the transport direction, the number N is equal to 6 and for transport with a longer side in the transport direction the number N is equal to 3.

18. A method according to claim 1, wherein each printing unit has a transport path in the form of a ring that are connected to one another by a connecting channel; and at least a part of the individual sheets of the group are in alternation in the connecting channel to the first ring and to the second ring.

19. A method according to claim 18, further comprising the step of:

transporting the sheets with an elevated speed in one of the connecting channel, the alternating delivery of the individual sheets to the rings and the transporting of the individual sheets into the proximity of the printing units compared to the transfer printing speed of the printing units.

20. A method according to claim 18, wherein the connecting channel is part of both rings and conveys individual sheets in only one direction.

21. A method according to claim 18, further comprising the step of:

following renewed passage of the individual sheets of the group past the first printing unit, one of outputting said sheets and supplying the individual sheets to the second printing unit for printing with the second printing color on the second side and then outputting the sheets.

22. A method according to claim 1, further comprising the step of:

retaining a distance between the individual sheets at the printing units during transport of the group of individual sheets.

23. A method according to claim 4, wherein the group of individual sheets first traverses the first transfer printing transport path, then the connecting channel, the second transfer printing transport path, the discharge channel, again traverses the connecting channel, the delivery channel, the first transfer printing transport path and is then output at the output section.

24. A method according to claim 4, wherein the predetermined number of individual sheets of a group derives as $$N \leq INT\left\{\frac{L_{44} + L_{46} + L_{48} + L_{50} + L_{52}}{L_B + a}\right\},$$

where $L_{44}$ is a length of the first transfer printing transport path, $L_{48}$ is a length of the connecting channel, $L_{50}$ is a length of the delivery channel, $L_{52}$ is a length of the discharge channel, $L_B$ is a length of the individual sheet as viewed in the transport direction and a is a spacing between two successive individual sheets at transfer printing speed.

25. A method according to claim 24, wherein the number N is equal to 11 for individual sheets in the DIN A4 format with a short side in the transport direction.

26. A method according to claim 18, wherein given an untriggered operating mode, the individual sheets of the one ring to be threaded in are supplied to the connecting channel with constant speed and are threaded in with this constant speed between individual sheets that derive from the other ring.

27. A method according to claim 26, wherein the individual sheets on transport paths from the fourth shunt up to the sixth shunt are transported with approximately constant speed.

28. A method according to claim 18, wherein given a triggered operating mode, the transport of the individual sheets of the one ring to be threaded in ensues dependent on a current position of at least one of the individual sheets between which threading occurs.

29. A method according to claim 28, wherein the individual sheet to be threaded in is slowed in speed are halted before access to the connecting channel.

30. A method for printing individual sheets in a printer or in a copier, comprising the steps of:

combining a predetermined number of individual sheets into a group, the individual sheets having a predetermined spacing from one another at transfer printing speed that is less than a length of an individual sheet as viewed in a transport direction;

successively supplying the individual sheets of the group to a first printing unit for printing with a first color on a first side;

turning over the sheets;

resupplying the individual sheets of the group to the first printing unit for printing with the first color on a second side;

subsequently supplying the individual sheets of the group to a second printing unit for printing with a second color on the second side; and outputting the sheets.

31. A method according to claim 30, wherein said step of supplying includes supplying the group of individual sheets to the first printing unit from an input section via a first transfer printing transport path to which a connecting channel connects and via which the individual sheets are supplied to a second transfer printing transport path for the second printing unit; further comprising the steps of:

discharging the second transfer printing transport path into an output section;

providing a discharge channel for the transport of the single sheets between the output section and one end of the connecting channel; and providing a delivery channel between the input section and an other end of the connecting channel.

32. A method according to claim 31, wherein the group of individual sheets first traverse the first transfer printing transport path, then the connecting channel, the delivery channel, traverse the first transfer printing transport path again, the connecting channel and then the second transfer printing transport path and are then output at the output section.

* * * * *